United States Patent [19]

Olsen et al.

[11] 4,158,273

[45] Jun. 19, 1979

[54] METHOD OF BLOCKING PLASTIC LENSES FOR SURFACING

[75] Inventors: Donald G. Olsen, Riverside; Nicholas Masi, Providence, both of R.I.

[73] Assignee: Crown Optical Company, Inc., Greenville, R.I.

[21] Appl. No.: 868,069

[22] Filed: Jan. 9, 1978

[51] Int. Cl.[2] ..... B24B 1/00

[52] U.S. Cl. ..... 51/284 R; 51/216 LP; 51/277

[58] Field of Search ..... 51/216 LP, 217 L, 284, 51/277

[56] References Cited

U.S. PATENT DOCUMENTS

| | | | |
|---|---|---|---|
| 2,441,472 | 5/1948 | D'Auaucourt | 51/277 |
| 3,383,808 | 5/1968 | Deshayes | 51/216 LP |
| 3,962,833 | 6/1976 | Johnson | 51/284 |
| 3,996,701 | 12/1976 | Ramirez | 51/216 LP |

*Primary Examiner*—Harold D. Whitehead
*Attorney, Agent, or Firm*—Salter & Michaelson

[57] ABSTRACT

An improved method and apparatus for blocking plastic lenses wherein an intermediate member in the form of a stiff, lightweight disc is interposed between the lens blank and a low melting point blocking material such that heat from the blocking material is absorbed by the member so as to prevent distortion of the lens blank. The face of the member is shaped so as to intimately conform to the standard convex side of the lens blank and is of a peripheral extent so as to provide stiffening support essentially over the entire surface thereof. The avoidance of lens distortion also enables lenses blocked in this manner to be re-blocked, if necessary, for corrective grinding.

8 Claims, 7 Drawing Figures

PRIOR ART

METHOD OF BLOCKING PLASTIC LENSES FOR SURFACING

BACKGROUND OF THE INVENTION

The present invention relates to the blocking of plastic lens blanks, that is, their support during the prescription grinding thereof. Such plastic lenses are conventionally provided in blank form having one surface thereof of a standard convex configuration and the other surface thereof adapted to be ground to the desired concave curvature. In order to adequately hold or position the blank with regard to the grinding machine, the blank is blocked, that is, a low melting point alloy is applied to the rear surface of the blank and molded in such a shape that the boss or block thus formed can be held or chucked to a portion of a grinding device so as to positively support the lens blank during the grinding operation.

In order to accomplish conventional blocking of a lens blank, it is known to initially place a flexible pad having an adhesive face in contact with the convex surface of the blank and thereafter mold, as by casting, melted blocking alloy directly to the rear surface of such pad. The pad is preferably of substantial thickness, on the order of 10 mils or more, and is formed of a heat insulative material such that when the alloy is applied directly thereto, the pad will at least to some extent serve to insulate the blank from the adverse effect of such heat, i.e., distortion of blank.

It has been found, however, that in many cases with the plastic lens blanks under consideration, the heat insulative effect of such pad is not adequate and accordingly some distortion of the lens blank takes place, which distortion impairs the optical accuracy of the lens being produced. Furthermore, the blank cannot be re-blocked should corrective grinding be required, because the ground lens is now so thin that re-blocking will invariably result in severe distortion. Any attempt to increase the thickness of the pad so as to correspondingly increase the heat insulative effect would be undesirable since such pads undesirably enable increased relative movement to occur between the block and the lens because of the inherent flexible nature of the materials utilized in forming the pad, which movement adversely affects the accuracy of the grinding operation. Such materials normally include natural or synthetic polymeric rubberlike materials such as polyvinyl chloride sheets and the like. Ideally, then, the pad should be extremely thin to reduce flexibility and formed of a highly insulative material so as to prevent lens distortion caused by the heat of the blocking material applied thereto. Unfortunately, such an ideal pad construction is not available.

A further drawback of known blocking procedures is that the necessary bulk to form the block portion of the blocked lens has been found, by reason of its relatively high weight, to contribute to undesirable distortion of the lens.

It is accordingly a primary object of the present invention to provide a lens blocking procedure which avoids the above indicated shortcomings of the prior art yet enables plastic lenses to be blocked and ground in an efficient, straight-forward manner, while at the same time utilizing conventional and existing blocking and grinding equipment.

A further object of the present invention is the provision of a process for enabling plastic lens blanks to be re-blocked if re-grinding is necessary.

Still another object of the present invention is the provision of a stiff, lightweight block component adapted to prevent heat distortion of an underlying lens blank when blocking material is applied directly to the block component and to further essentially fully support such lens blank during grinding.

These and other objects of the present invention are accomplished by the provision of a disc-like member having a concave surface shaped to closely conform to the convex surface of a standard plastic lens blank and having a hub upstanding from the rear surface thereof. Such member is adhesively connected to the lens blank by a very thin adhesive layer and thereafter low temperature melting point blocking material applied directly thereto and molded thereon so as to form an integrally formed block on the rear surface thereof. The member is of stiff, lightweight material having a melting or distortion point substantially higher than the melting point of the low temperature melting point blocking materials such that the member absorbs the heat from the blocking material so as to in effect insulate the lens blank and thus prevent heat distortion thereof.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
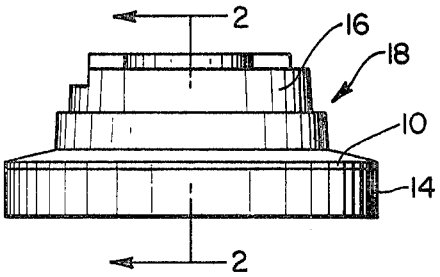
FIG. 1 PRIOR ART
FIG. 1 is a side sectional view showing a conventionally formed lens block assembly.
Figure 2:
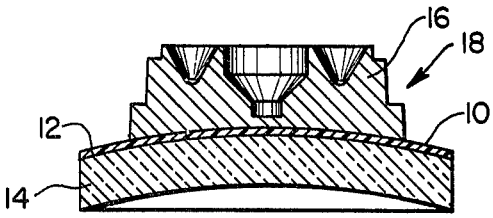
FIG. 2 is a sectional view of FIG. 1 showing the particular member in which blocking material may be applied directly to the rear of an at least partially heat insulative pad.
Figure 3:
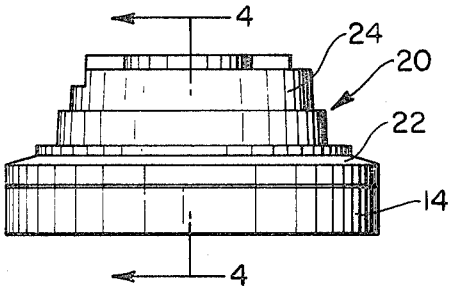
FIG. 3 is a side sectional view showing a blocked plastic lens assembly made in accordance with the present invention.
Figure 4:
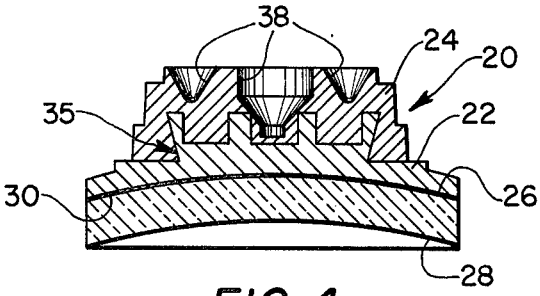
FIG. 4 is a sectional view taken along the line 4—4 of FIG. 3.
Figure 5:
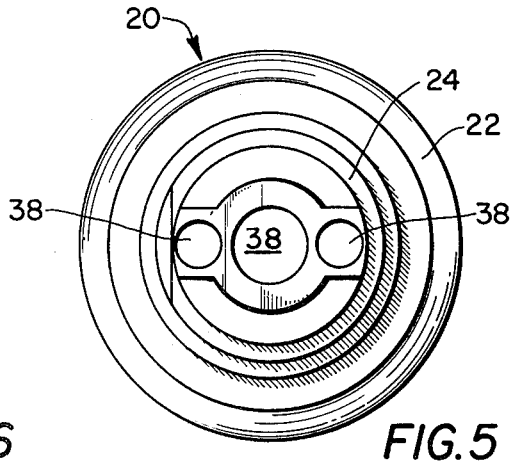
FIG. 5 is a top plan view of the lens assembly shown in FIG. 3.
Figure 6:
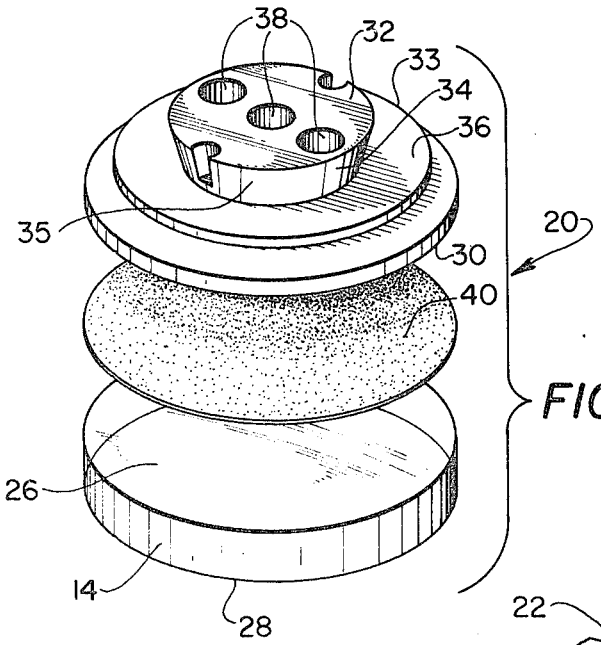
FIG. 6 is an exploded perspective view showing component parts of the blocked lens assembly of the present invention.

The manner in which plastic lens blanks are presently blocked is shown in FIGS. 1 and 2 of the drawing. Therein a sheet 10 of flexible material is adhered to the convex surface 12 of a plastic lens blank 14 so as to intimately conform thereto. At least the front surface of the sheet 10 is provided with an adhesive to accomplish such action. Sheets formed of polyvinyl chloride material are commonly utilized for this purpose. Thereafter, a block 16 of conventional configuration is formed directly to the back of such sheet by conventional molding techniques. Low temperature melting point alloys, such as bismuth containing alloys, which melt at temperatures of about 117° F. are utilized to form the block.

This procedure forms a lens blank blocking assembly 18.

While fully satisfactory for glass lenses, this procedure may distort plastic lenses inasmuch as the conventional plastic materials utilized for lens construction are quite susceptible to heat distortion. Furthermore, the bulk of the block 16 is such that its weight may cause the ground lens to creep or distort.

Turning now to FIGS. 3–6 of the drawing, the construction and method of forming the lens blank assembly of the present invention is shown. Such lens blank assembly is designated by reference numeral 20 and includes a standard plastic lens blank 14, intermediate member 22 and a block 24 of a conventional configuration formed from low melting point alloys above indicated useful for this purpose. Unground lens blanks 14 are conventionally provided with a convex surface of various standard configurations depending on the particular strength or corrective nature of the final lens to be formed. The opposite side of the lens blank 14 includes a normally concave surface which is ground so as to provide a finished lens construction of desired curvature or configuration. The overall shape of the lens is, of course, dependent upon the intended use of the finished lens, but for purposes of explanation herein it may be assumed to be circular.

Member 22 is generally of disc-like configuration and includes a concave front surface 30 shaped to intimately mate with the convex surface 26 of the blank 14. The member further includes a central hub 32 upstanding from the rear surface 33 of the member. The hub includes peripheral sidewalls 34 which incline outwardly so as to form a distinct vertically orientated undercut 35. The rear surface of the member 22 may further include a step 36 which adds body or thickness to the member and further may be used as a support for a known mold construction for receipt of blocking material such as a low melt bismuth alloy which melts at approximately 117° F. Such blocking material is applied directly to and surrounding the hub 32 such that it flows into the undercut 35 and in contact with the sidewalls 34 so that upon cooling, a firm mechanical interlock is formed between the block 24 and the member 22. The block 24 is further provided with openings 38 in the top face thereof, which openings are adapted to receive positioning points of a chucking device of a grinding machine, as is known in the art.

In order to reduce the weight of the composition block 20 of the present invention, the member 22 is formed of an extremely lightweight material such as aluminum. It is also necessary that the member be stiff and formed of a material whose melting, softening or distortion point is well above the melting point of the blocking material 24 such that the member 22 will not distort or otherwise deform when the melted blocking material is applied thereto. In practice, the member 22 is adhesively connected to the lens block 14 by means of an extremely thin doublesided adhesive element 40. Such element preferably is about a mil in thickness and formed from adhesive sheets commercially available, such as those available from 3M Company. The planar extent of the element 40 is cut to size so as to fully conform to the convex surface 26 of the lens blank and thereafter applied thereto. Subsequently member 22 is forced thereagainst so as to interconnect it with the lens blank by means of the adhesive sheet or element 40. The extreme thinness of the element 40 assures a stable, essentially nonflexible connection between the lens blank 14 and the member 22 while the lateral or peripheral extent of the member 22 further assures that eventually the entire rear surface 26 of the blank is fully supported during grinding operations. Both of these features of the present invention assure consistent non-distortion grinding of plastic lens blanks.

Additionally, by reason of the lighter weight of the composite block 20 of the present invention, as contrasted with heavier or more dense block 18 of the prior art, the likelihood of pressure or creep distortion before or after grinding is minimized. It should be additionally noted that a further advantageous feature of the present invention is accomplished by the ability of the member 22 to absorb or otherwise divert or insulate the heat from the molten blocking material applied thereto from distoring the plastic lens 14 connected to its opposite face. Thus, the member 22 is formed of a somewhat conductive material, such as aluminum, which acts as a heat sink through which heat can be absorbed and at least partially dissipated to those peripheral surface portions thereof outwardly extending from the peripheral extent of the block 24. In those cases where the material is formed primarily from a heat insulative material, its thickness assures that heat from the molten alloy will not adversely affect the lens blank.

Figure 7:
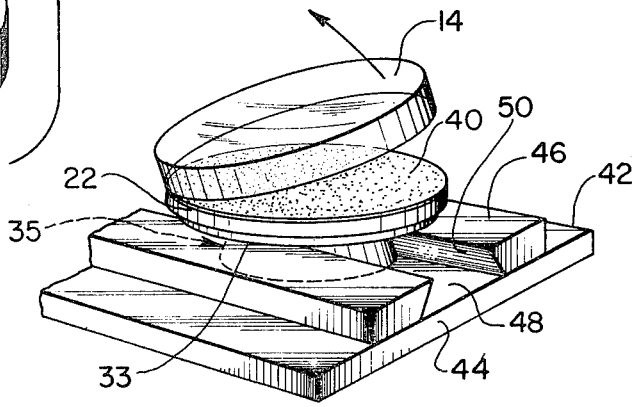
FIG. 7 is a perspective view of a jig or fixture by which the ground lens may be easily removed from the block assembly.

After the lens is blocked and ground, the block 24 is removed therefrom, as by melting of such in hot water. In such form the partially blocked lens is thereafter removed from the member 22 by forcing it away from the adhesive element 40. Such step may be facilitated by use of the jig or fixture 42 shown in FIG. 7 of the drawing. Therein, fixture 42 includes a body 44 and upstanding longitudinally orientated trackways 46 defining an undercut slot 48. The walls 50 of the slot are downwardly outwardly directed and spaced from each other a distance generally equal to the diameter of the hub 32 so as to snugly accommodate its sliding placement thereinto. Such fixture serves to positively hold the member 22 in place so that the ground lens blank may be forcibly peeled off therefrom. One the ground blank has been removed from the blocking assembly, it is inspected for correctness and if found to require additional grinding may be re-blocked utilizing the same disc-like member 22 in the blocking procedure as above descirbed, inasmuch as such procedure enables the lens blank 14 and its convex surface 26 to remain undistorted, as previously described.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method of grinding a plastic lens, comprising providing a plastic lens blank having a standard convex surface and an opposite surface to be ground, temporarily connecting a stiff, lightweight, disc-like member having a front concave surface shaped to closely conform to the convex surface of said blank and of a peripheral extent substantially equal thereto to said blank by means of a thin adhesive layer so that said surfaces are face-to-face and said member is essentially peripherally coextensive with said blank, said member having an undercut hub upstanding from the central rear surface thereof, and thereafter forming a lens block on the rear central surface of said member by molding a liquid low melting point blocking material directly to and surrounding said hub to form a block thereon whereby said block and said member are integrally joined and wherein heat from said blocking material is absorbed by said member so that said blank is not distorted thereby.

2. The process of claim 1, wherein said member is formed from a material having a melting point substantially higher than said low melting point blocking material.

3. The process of claim 2, said member formed of aluminum.

4. The process of claim 1, thereafter mounting said lens block in a grinding device, grinding the opposite surface of said lens blank, melt removing said block from said member and thereafter removing said ground lens from said member.

5. The process of claim 4, wherein the lens is removed from said member by supporting said member in a fixture having an undercut slot, the sides of said slot contacting the sidewalls of said hub, and then peeling said ground lens from said member.

6. The process of claim 1, said adhesive layer being a preformed, double-sided adhesive film.

7. The process of claim 2, said member material having a density substantially less than that of said low melting point blocking material.

8. The process of claim 3, said blocking material being a low melting bismuth alloy.

* * * * *